US005138537A

United States Patent [19]

Wang

[11] Patent Number: 5,138,537

[45] Date of Patent: Aug. 11, 1992

[54] VARIABLE LIGHT BEAM FLASHLIGHT

[76] Inventor: Howard Wang, No. 7, Alley 14, Lane 64, Ching Ping Rd., Chung Ho City, Taipei Hsien, Taiwan

[21] Appl. No.: 783,507

[22] Filed: Oct. 28, 1991

[51] Int. Cl.[5] ..... F21L 7/00

[52] U.S. Cl. ..... 362/187; 362/202

[58] Field of Search ..... 362/202, 187, 188, 203, 362/205

[56] References Cited

U.S. PATENT DOCUMENTS 4,286,311 8/1981 Maglica ..... 362/187 X 4,807,097 2/1989 Gammache ..... 362/187 X 4,949,231 8/1990 Wang ..... 362/188 X

*Primary Examiner*—Stephen F. Husar

*Attorney, Agent, or Firm*—Rogers, Howell & Haferkamp

[57] ABSTRACT

A flashlight including a tube for receiving a battery, a control ferrule threadedly engaged on the upper end of the tube, a face cap and a reflector engaged on an upper end of the control ferrule, a sleeve and a socket engaged in the upper end of the tube for receiving a light bulb, a ring engaged in the sleeve and electrically connected to the upper end of the tube, the light bulb including an annular flange connected to the ring and being caused to move relative to the reflector when the control ferrule is rotated relative to the tube.

5 Claims, 2 Drawing Sheets

VARIABLE LIGHT BEAM FLASHLIGHT

BACKGROUND OF THE INVENTION

1. Field of the Invention

The present invention relates to a flashlight, and more particularly to a variable light beam flashlight.

2. Description of the Prior Art

The closest prior art of which applicant is aware is his prior U.S. Pat. No. 4,949,231 to Wang, entitled "VARIABLE LIGHT BEAM FLASHLIGHT". Most of the flashlights which are available at present comprise a plurality of parts, which increase the manufacturing cost of the flashlights.

The present invention has arisen to mitigate and/or obviate the afore-described disadvantages of the conventional flashlights.

SUMMARY OF THE INVENTION

The primary objective of the present invention is to provide a flashlight which has a simplified configuration such that the manufacturing cost thereof is greatly reduced.

In accordance with one aspect of the invention, there is provided a flashlight including a tube having a tail cap disposed at the lower end, a battery disposed in the tube, a control ferrule threadedly engaged on an upper end of the tube, a face cap and a barrel engaged on an upper end of the control ferrule, a reflector formed in the barrel, a sleeve engaged in the upper end of the tube, a ring engaged in the sleeve and electrically connected to the upper end of the tube, a socket engaged in the sleeve, a light bulb having a base engaged in the socket and including a contact connected to a central electrode of the battery and an annular flange connected to the ring, and the light bulb being caused to move relative to the reflector when the control ferrule is rotated relative to the tube.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
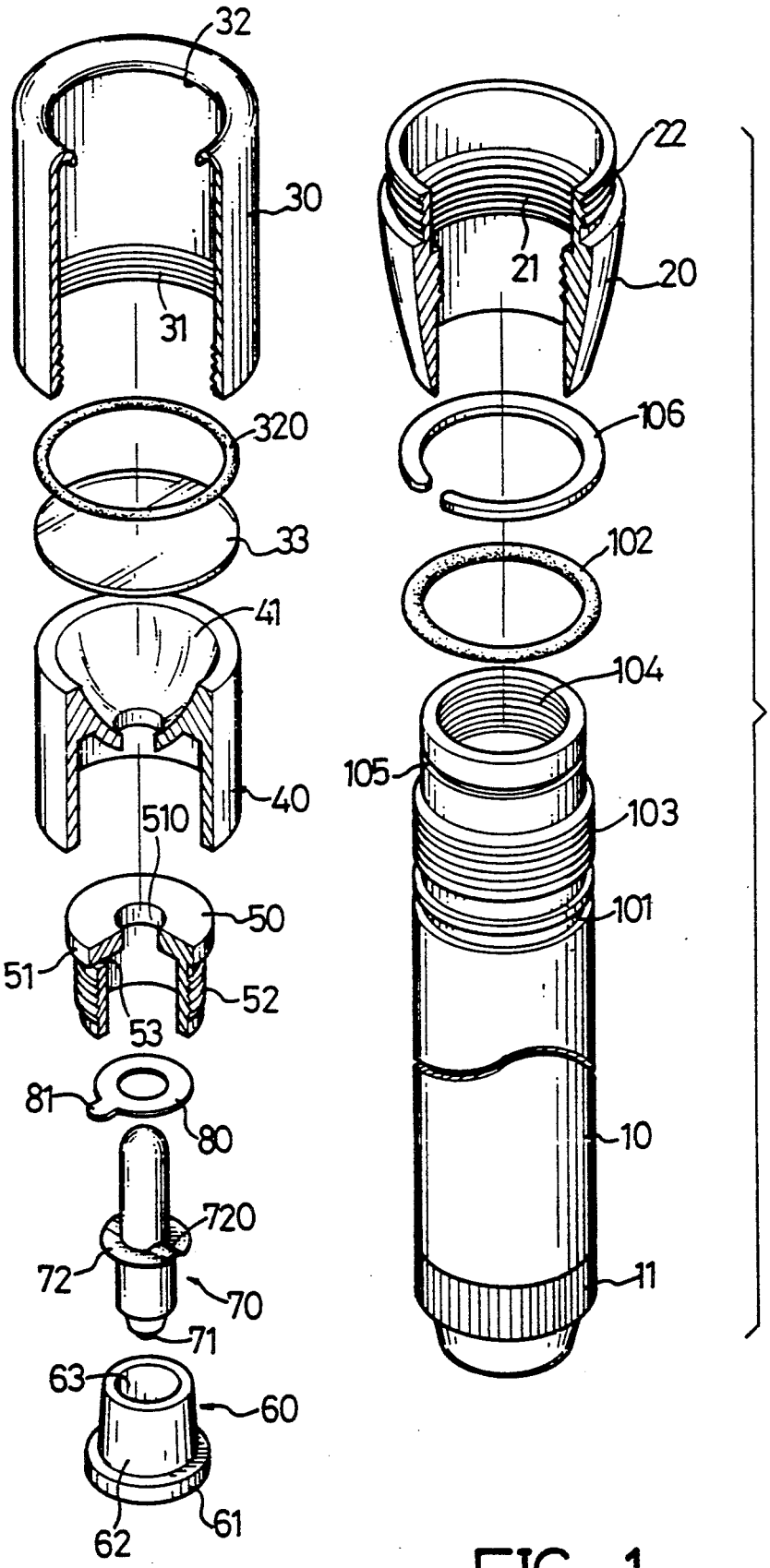
FIG. 1 is an exploded view of a flashlight in accordance with the present invention.
Figure 2:
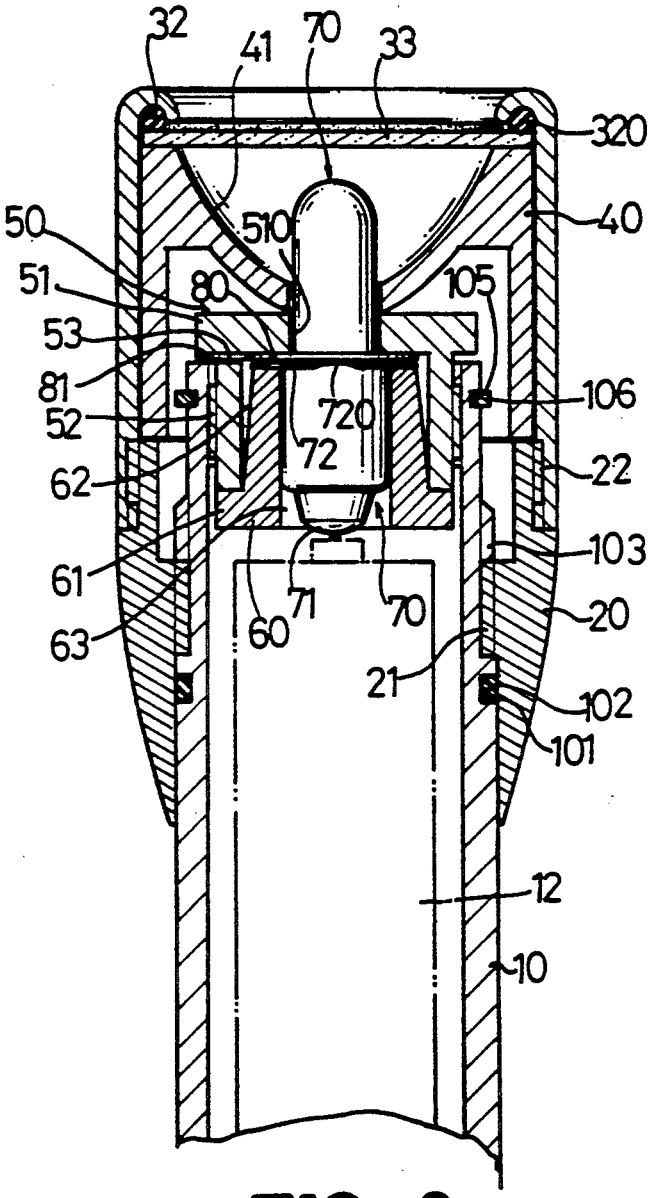
FIG. 2 is a partial cross sectional view of the flashlight.

Referring to the drawings and initially to FIGS. 1 and 2, a flashlight in accordance with the present invention comprises generally a cylindrical tube 10 having a tail cap 11 disposed on the lower end thereof and having at least one battery 12 disposed therein, a control ferrule 20, a face cap 30, a barrel 40, a sleeve 50, a socket 60, and a light bulb 70.

The cylindrical tube 10 includes an annular groove 101, an outer thread 103 and an annular recess 105 formed on the upper and outer peripheral portion thereof and an inner thread 104 formed in the upper and inner peripheral portion thereof. A sealing ring 102 is engaged in the annular groove 101, and a clamping ring 106 is engaged in the annular recess 105. The control ferrule 20 includes an inner thread 21 formed therein for threaded engagement with the outer thread 103 of the cylindrical tube 10, and an outer thread 22 formed on the outer peripheral portion thereof. The sealing ring 102 provides a water-tight seal between the cylindrical tube 10 and the control ferrule 20. The clamping ring 106 prevents the control ferrule 20 from disengaging from the cylindrical tube 10.

The face cap 30 includes an inner thread 31 formed in the lower portion for threaded engagement with the outer thread 22 of the control ferrule 20, and an annular cavity 32 formed in the upper portion for receiving a sealing ring 320. A lens 33 is received in the face cap 30 and is engaged with the sealing ring 320. The barrel 40 has an upper peripheral edge engaged with the lens 33 and has a lower peripheral edge engaged with the upper peripheral edge of the control ferrule 20 so that the barrel 40 can be stably retained in place and moves in concert with the control ferrule 20 and the face cap 30. The barrel 40 includes a parabolic reflector 41 formed integral in the upper portion thereof.

Figure 3:
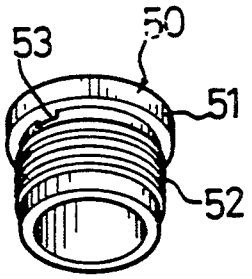
FIG. 3 is a perspective view of a member of the flashlight.

The sleeve 50 includes a disc 51 formed integral on the top thereof, an outer thread 52 formed on the outer peripheral surface thereof for threaded engagement with inner thread 104 of the cylindrical tube 10, and an opening 53 formed therein (FIG. 3). The disc 51 includes a hole 510 formed in the center thereof. A ring 80 which is made of conductive materials is engaged in the sleeve 50 and includes a protrusion 81 extended through the opening 53 of the sleeve 50. As best shown in FIG. 2, the protrusion 81 is caused to contact with the upper end of the cylindrical tube 10 when the sleeve 50 is threadedly engaged to the cylindrical tube 10.

The outer peripheral surface of the socket 60 is preferably tapered so that the socket 60 can be engaged within the sleeve 50 by such as force-fitted engagement. The socket 60 includes an annular flange 61 formed on the lower end thereof for engagement with the lower end of the sleeve 50. The socket 60 and the sleeve 50 are made of insulating materials. The light bulb 70 has a base portion engaged in the bore 63 of the socket 60 and includes a contact 71 formed in the bottom of the base portion and an annular flange 72 provided on the middle portion thereof. The annular flange 72 includes a swelling 720 formed thereon. Contact 71 and annular flange 72 are electrically connected to opposite ends of the bulb filament (not shown).

The contact 71 contacts the center electrode of the battery 12. The annular flange 72 is electrically connected to the ring 80, which is in turn electrically connected to the cylindrical tube 10 via the protrusion 81 thereof. The cylindrical tube 10 can be electrically connected to the case electrode of the battery 12 when, for example, the tail cap is pressed by a user. The configuration for controlling the pressing of the tail cap is not related to the present invention and will not be described in further details. One type of the configuration is shown and disclosed in applicant's prior U.S. Pat. No. 4,949,231.

A rotational movement of the control ferrule 20 makes the reflector 41 move upward relative to the light bulb 70 so that the light bulb 70 longitudinally slides relative to the reflector 41 so as to produce a variable dispersion of the light beam.

Accordingly, the flashlight in accordance with the present invention has a simplified configuration including few parts, which greatly reduces the manufacturing costs thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flashlight comprising a cylindrical tube having a tail cap provided at a lower end thereof; at least one battery disposed in said cylindrical tube; a control ferrule threadedly engaged on an upper end of said cylindrical tube; a face cap engaged on an upper end of said control ferrule; a barrel engaged in said face cap and moved in concert with said face cap and said control ferrule, said barrel including a reflector formed therein; a sleeve threadedly engaged in said upper end of said cylindrical tube; a ring engaged in said sleeve and electrically connected to said upper end of said cylindrical tube; a socket engaged in said sleeve; a light bulb having a base engaged in said socket and including a first electrode connected to a central electrode of said battery and a second electrode connected to said ring; and said light bulb being caused to move relative to said reflector when said control ferrule is rotated relative to said cylindrical tube.

2. A flashlight according to claim 1, wherein said sleeve includes an opening formed therein, said ring includes a protrusion extended therefrom and extended through said opening of said sleeve in order to be electrically connected to said upper end of said cylindrical tube.

3. A flashlight according to claim 2, wherein said sleeve includes a disc formed integral in an upper portion thereof, said disc has a hole formed in a center thereof through which an upper portion of said light bulb is extended, said ring is engaged with said disc, and said opening is formed in said sleeve below said disc.

4. A flashlight according to claim 1, wherein said socket includes an annular flange formed on a lower end thereof for engagement with a lower end of said sleeve, and includes a tapered outer peripheral surface so that said socket can be force-fitted into said sleeve.

5. A flashlight according to claim 1, wherein said light bulb includes an annular flange formed thereon, said annular flange includes a swelling formed thereon for electrically engaging with said ring.

* * * * *